US007685853B2

(12) United States Patent
Burkart

(10) Patent No.: US 7,685,853 B2
(45) Date of Patent: Mar. 30, 2010

(54) PIN-A-PLUG TIME SAVING DEVICE FOR RE-KEYING A LOCK

(76) Inventor: Ronald F. Burkart, 124 Windsor Pl., Chapel Hill, NC (US) 27516

( * ) Notice: Subject to any disclaimer, the term of this patent is extended or adjusted under 35 U.S.C. 154(b) by 0 days.

(21) Appl. No.: 12/219,792

(22) Filed: Jul. 29, 2008

(65) Prior Publication Data

US 2010/0024498 A1 Feb. 4, 2010

(51) Int. Cl.
*E05B 9/04* (2006.01)

(52) U.S. Cl. ..... 70/375; 70/378; 29/464; 29/804

(58) Field of Classification Search ..... 70/375, 70/378, 382–385, 431, DIG. 15, DIG. 44, 70/DIG. 75; 29/804, 251, 281.1, 200, 464; 33/539, 540

See application file for complete search history.

(56) References Cited

U.S. PATENT DOCUMENTS 1,437,832 A * 12/1922 Bradley, Jr. ..... 29/464
3,111,748 A * 11/1963 Doll et al. ..... 29/712
3,218,699 A * 11/1965 Maese ..... 29/423
3,417,452 A * 12/1968 Roland ..... 29/804
3,664,007 A * 5/1972 Schlage ..... 29/271
4,391,112 A * 7/1983 Neyret ..... 70/493
4,763,395 A * 8/1988 Fontaine ..... 29/436
5,609,052 A * 3/1997 Denning ..... 70/368
6,021,655 A * 2/2000 Labbe et al. ..... 70/493
2009/0000113 A1 * 1/2009 Komemi ..... 29/804

* cited by examiner

*Primary Examiner*—Suzanne D Barrett
(74) *Attorney, Agent, or Firm*—Robert M. M. Seto

(57) ABSTRACT

A device for re-keying a lock that frees the locksmith from having to handle individual tumblers. A magazine is provided for each tumbler in the lock. Each magazine is numbered or coded to indicate the size of the tumblers within. The magazines fit into the top of a housing that temporarily holds the plug portion of the lock to be re-keyed. Upon alignment of the magazines with their corresponding holes in the plug, the tumblers fall into place and the lock has effectively been re-keyed. The plug is then removed from the housing and ready to be placed back in its original lock assembly.

5 Claims, 3 Drawing Sheets

PIN-A-PLUG TIME SAVING DEVICE FOR RE-KEYING A LOCK

BACKGROUND OF THE INVENTION

The present invention relates generally to the field of locksmiths and more specifically to a method for quickly and efficiently re-keying a lock.

Locksmiths are skilled at working on locks of all kinds, including locks in the front doors of homes and businesses. When a homeowner or business owner wants to "change the locks" on their doors, they have the option of actually buying an entirely new lock assembly for each door and replacing the old assembly with the new one. This process can be expensive, since it involves purchasing a new lock assembly for every door. More often than not, the business owner will "change the locks" on his doors by having a locksmith re-key the old lock. Re-keying only involves replacing the old tumblers in the lock assembly with new tumblers, and allows the rest of the lock assembly to still be used. After the tumblers have been replaced, the old key can no longer be used to open the lock. This method of re-keying is generally more cost effective than replacing entire lock assemblies. When a locksmith re-keys a lock, he removes the old tumblers from the plug of the lock and replaces them with new tumblers having different sizes than the old tumblers. A new key, that has been cut to match the new tumblers, must then be used to open the lock. Re-keying a lock can be a tedious process, since the tumblers are very small and each tumbler must be placed into a corresponding hole in the plug. For locksmiths with large fingers or bad eyesight, the chance of dropping and losing the tumblers on the ground is great. Because a number of small items (multiple tumblers) must found, tracked and manipulated, re-keying a lock can be time consuming.

What is needed in the field is a device that allows a lock to be re-keyed quickly and efficiently. The ideal device would not require the locksmith to handle the individual tumblers, nor force the locksmith to try and fit each tumbler into a corresponding small hole in the lock's plug by hand.

SUMMARY OF THE INVENTION

A device for re-keying a lock that includes a housing, a housing holder and multiple magazines. The housing has an upper portion, a front, a rear, and an at least partially hollow interior. The upper portion of the housing has multiple holes that lead into the hollow interior of the housing. The housing holder supports and rotate-ably holds the housing. The housing holder is capable of rotating the housing at least 45 degrees. Each of the multiple magazines are adapted to hold multiple tumblers in their interior, one on top of the other. The magazines are complementary in size to the holes in the upper portion of the housing so that the magazines can be inserted into, and held within, the holes in the housing.

The device further comprises a follower, wherein the follower fits into the rear of the housing and is able to slide through the interior of the housing. The follower is able to assist in removing any plug that is inserted into to the housing for re-keying. The device also includes a magazine holder, wherein the magazine holder is attached to the upper portion of the housing. The housing holder is able to rotate the housing 90 degrees, which allows the open ended magazines to be loaded into the housing without any tumblers falling out. The magazines fit into the holes in magazine holder and holes in the upper portion of the housing and do not protrude into the interior of the housing. The front of the housing includes an opening that is adapted to accept a plug from the lock. The plug is able to fit into the interior of the housing and the holes for the tumblers line up with the holes for the magazines. The opening in the front of the housing has an adjustable size that allows for plugs of different sizes and thicknesses. The opening in the front of the housing also includes a stop that defines a maximum insertion distance of plug into the housing. The stop is designed to catch a lip near the front of the plug and assist in lining up the tumbler holes in the plug with the tumblers in the magazines.

It is an object of the present invention to provide a device that makes re-keying a lock much easier and faster.

BRIEF DESCRIPTION OF THE DRAWINGS

The invention of the present application will now be described in more detail with reference to the accompanying drawings, given only by way of example, in which.

DETAILED DESCRIPTION OF THE INVENTION

Figure 1:
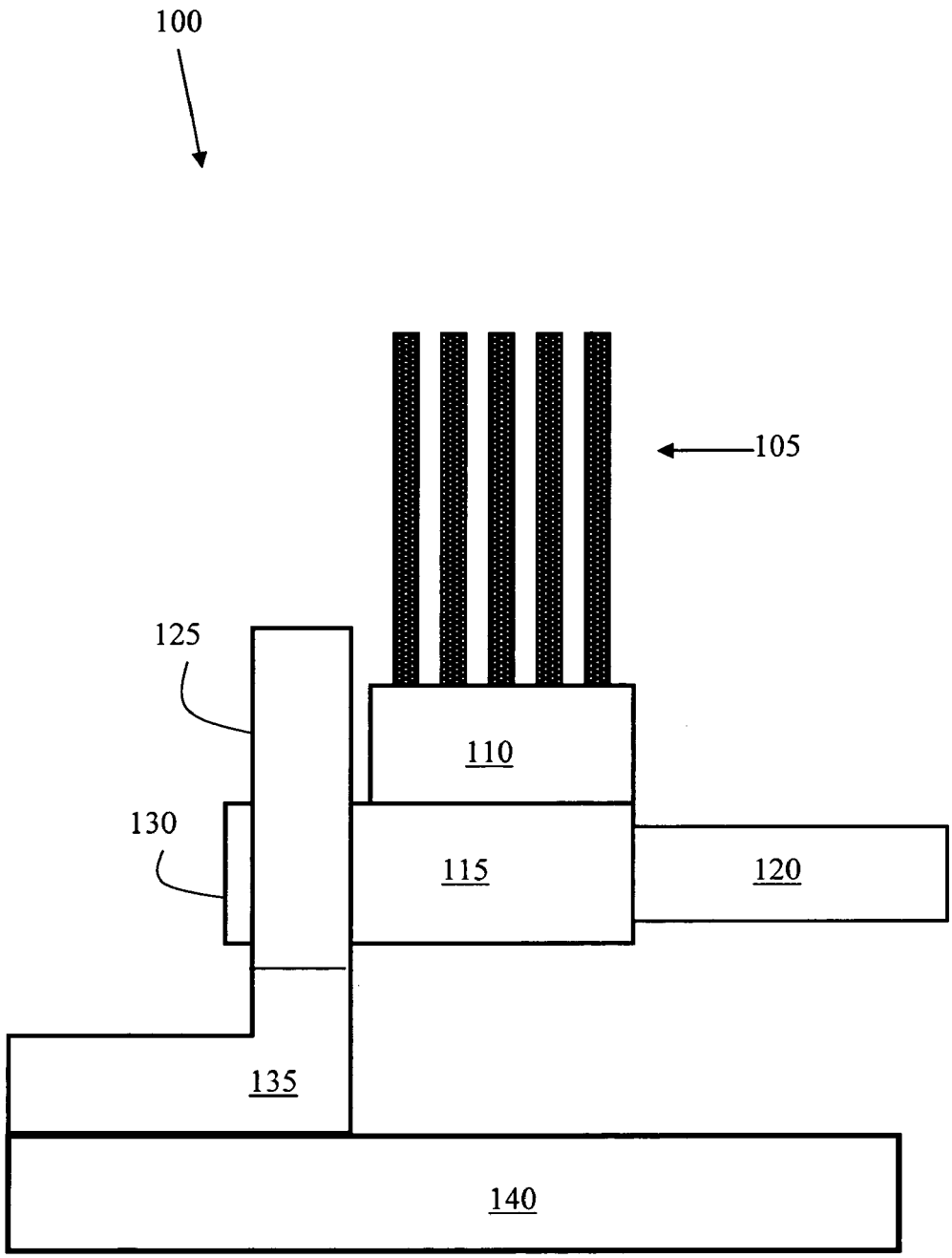
FIG. 1 is a side view of the preferred embodiment.

FIG. 1 shows a side view of the preferred embodiment of the present Pin-A-Plug time saving device 100 for re-keying a lock. The device 100 includes a base 140, a housing holder 125 & 135, a housing 115, a follower 120, a magazine holder 110 and multiple magazines 105. The housing 115 is designed to simulate the lock assembly and hold the plug portion of the lock in its interior during the re-keying process. The plug is removed from its original assembly and inserted into the housing through the front 130 of the housing. The follower 120 starts out fully inserted into the interior of the housing through the rear of the housing. The follower 120 keeps the tumblers that are in the magazines 105 from falling into the interior of the housing 115 prematurely. As the plug is pushed into the housing through the front, the follower 120 is moved backwards and outside the rear of the housing 115. The housing 115 is long enough so that the follower is not pushed completely out of the housing 115 when the plug is inserted. The follower 120 remains partially within the housing 115, and after the plug has been re-keyed, the follower is used to assist in removing the plug from the housing, by pushing the plug from the rear. The magazines each hold multiple tumblers, with each tumbler is stacked in a vertical orientation one on top of the other the magazines. This allows each magazine to be used to re-key multiple locks without having to re-load the magazines. The magazine holder 110 is attached to the top of the housing 115 and the holes in the magazine holder 110 line up with the holes in the top of the housing 115. The holes in the top of the housing 115 lead to the hollow interior of the housing, and when a plug is fully inserted in the housing, the holes in the housing line up with the tumbler holes in the plug.

Figure 2:
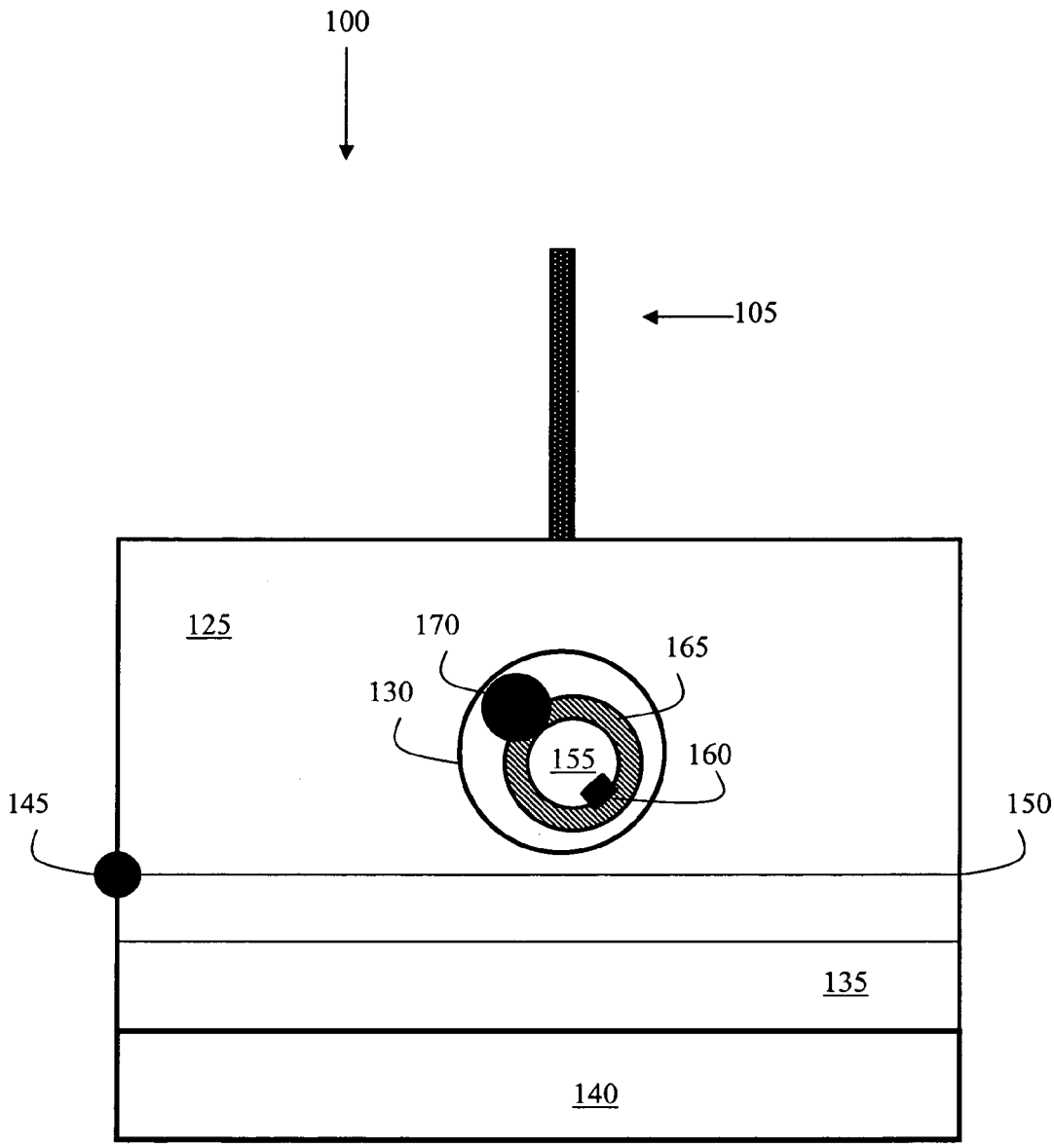
FIG. 2 is a frontal view of the preferred embodiment.

FIG. 2 shows a frontal view of the preferred Pin-A-Plug device 100. The top portion 125 of the housing holder is attached to the bottom portion 135 of the holder by a hinge 145, which allows for tilting of the top portion 125 and subsequent rotation of the housing. The front 130 of the housing includes a spring loaded pusher 170 that allows plugs with lips of different thicknesses to fit into the housing. The spring loaded pusher 170 also allows the present device 100 to be used to re-key plugs that have tumbler holes with different spacing between the front of the plug and the first tumbler hole. The front 130 of the housing further includes a housing lip 165 and a housing peg 160, which are designed to define a maximum insertion distance for a plug, and allow for proper alignment with any notch that may be included on the front of the plug. When the re-keying process is started, the opening 155 to the housing is empty, the follower is pushed into the housing, the magazines 105 are not yet inserted, and the top portion 125 of the housing holder, along with the housing itself, are tilted on their side. The magazines 105 are selected, based on the desired tumbler sizes to be used, and the magazines 105 are inserted into the magazine holder. Each magazine is either numbered or coded so that the size of the tumblers inside each magazine are easily determined. Each tumbler in a single magazine are of the same size. The top portion 125 of the housing holder, along with the housing, are then laid back down on top of the bottom portion 135 of the housing holder. The plug to be re-keyed is inserted into the opening 155 in the front 130 of the housing, and the follower is subsequently pushed backwards and at least partially out of the rear of the housing. The plug is then twisted until the tumbler holes in the plug line up with the open bottoms of the magazines. One tumbler from each magazine is then pulled by gravity into their corresponding tumbler hole. The follower is then used to push the plug out of the front 130 of the housing and the plug has been re-keyed. As the follower moves forward, the periphery of the follower covers the holes in the top of the housing so that no more tumblers are allowed to fall out of the magazines. The re-keyed plug is then removed from the housing and ready to be reinstalled in its original lock assembly. The top portion 125 of the housing holder is then tilted on its side again and the magazines are removed and stored for later use. The process can start over again to re-key another lock, or the top portion 125 of the holder can be laid back down and the device 100 stored until it is needed again.

Figure 3:
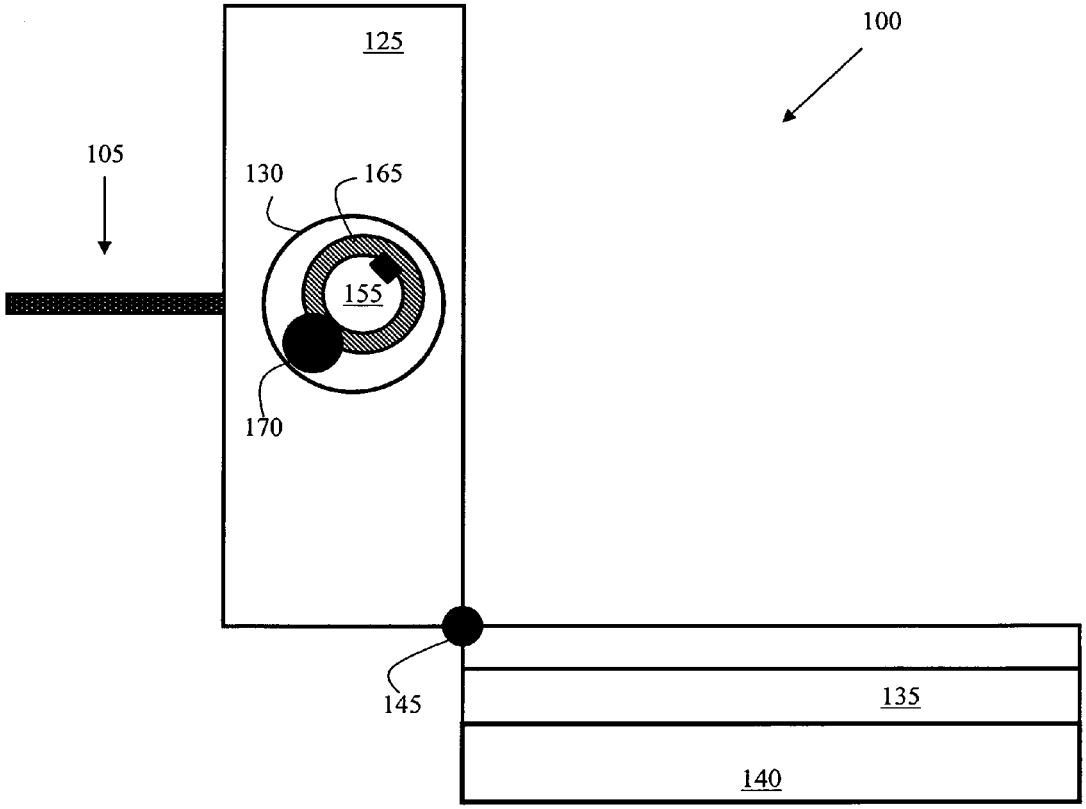
FIG. 3 is a frontal view of the preferred embodiment with the housing rotated 90 degrees.

FIG. 3 shows the Pin-A-Plug device 100 in the tilted position with the top portion 125 of the housing holder moved to a vertical orientation. In the tilted position, the housing is rotated 90 degrees. This results in the magazines being able to lay on their sides. The magazines are preferably sealed at their tops and open at their bottoms. Laying the housing on its sides allows for easy insertion of the magazines into the magazine holder without the threat of tumblers falling out of the magazines prematurely. In an alternative embodiment, the housing is rotate-ably held within the housing holder, and the housing is twisted in order to rotate the housing on its side. After insertion of the magazines, the housing is twisted back to its original position.

The foregoing description of the specific embodiments will so fully reveal the general nature of the invention that others can, by applying current knowledge, readily modify and/or adapt for various applications such specific embodiments without departing from the generic concept. For example, the device could be used without a follower, wherein the plug is inserted in the housing while the housing is still on its side, and a key could be used to pull the plug out of the housing after re-keying. Therefore, such adaptations and modifications should and are intended to be comprehended within the meaning and range of equivalents of the disclosed embodiments. It is to be understood that the phraseology of terminology employed herein is for the purpose of description and not of limitation.

I claim:

1. A device for re-keying a lock, the device comprising:

a housing, the housing having an upper portion, a front, a rear, and an at least partially hollow interior, wherein the upper portion of the housing has multiple holes that lead into the hollow interior of the housing;

a housing holder that supports and rotate-ably holds the housing, the holder providing for a rotation of the housing of at least 45 degrees; and, multiple magazines, wherein each magazine is adapted to hold multiple tumblers, and the magazines are complementary in size to the holes in the upper portion of the housing so that the magazines can be inserted into, and held within, the holes, further comprising a follower, wherein the follower fits into the rear of the housing and is able to slide through the interior of the housing, wherein the follower is able to assist in removing any plug that is inserted into the housing through the front of the housing.

2. The device of claim 1, further comprising a magazine holder, wherein the magazine holder is attached to the upper portion of the housing and the magazine holder includes a hole for each of the magazines.

3. The device of claim 2, wherein there are at least four magazines.

4. The device of claim 3, wherein the housing holder is able to rotate the housing 90 degrees.

5. The device of claim 4, wherein the magazines fit into the holes in magazine holder and the holes in the upper portion of the housing, and the magazines do not protrude into the interior of the housing.

* * * * *